United States Patent [19]

King et al.

[11] 3,988,088

[45] Oct. 26, 1976

[54] PRESS FOR PARTICULATE MATERIAL

[75] Inventors: Jerry A. King, Palm Beach Gardens; Vernon F. Manz; Donald G. MacNitt, Jr., both of North Palm Beach, all of Fla.

[73] Assignee: United Technologies Corporation, Hartford, Conn.

[22] Filed: Dec. 4, 1975

[21] Appl. No.: 637,624

[52] U.S. Cl. ..... 425/78; 425/73; 425/258; 425/126 R; 425/128; 425/412; 425/407

[51] Int. Cl.[2] ..... B30B 11/02

[58] Field of Search ..... 425/78, 407, DIG. 35, 425/412, 126, 128

[56] References Cited

UNITED STATES PATENTS

| | | | |
|---|---|---|---|
| 2,393,130 | 1/1946 | Toulmin | 425/78 X |
| 3,156,011 | 11/1964 | Olson | 425/78 X |
| 3,189,942 | 6/1965 | Rapprich et al. | 425/78 |
| 3,307,221 | 3/1967 | Bolner | 425/DIG. 35 |
| 3,521,326 | 7/1970 | Rice et al. | 425/78 |
| 3,555,597 | 1/1971 | Meadows | 425/78 |
| 3,577,842 | 5/1971 | Nakai et al. | 425/78 X |
| 3,832,107 | 8/1974 | Cox et al. | 425/78 |

*Primary Examiner*—J. Howard Flint, Jr.
*Attorney, Agent, or Firm*—Charles A. Warren

[57] ABSTRACT

Apparatus for converting particulate metallic matter into a billet or a forged article in which the material is fed in measured quantity from a hopper to a furnace for outgassing and other heat treatment and thence to a press in which the particulate material is compacted into a container or mold to form either a billet or forged article. When the billet is formed, the press also applies a cover to the container to keep the material free of contamination until a later heat treatment or forging operation. Mechanism is provided for removing the completed billet or mold from the press and insertion of a new container.

12 Claims, 12 Drawing Figures

Fig. 3
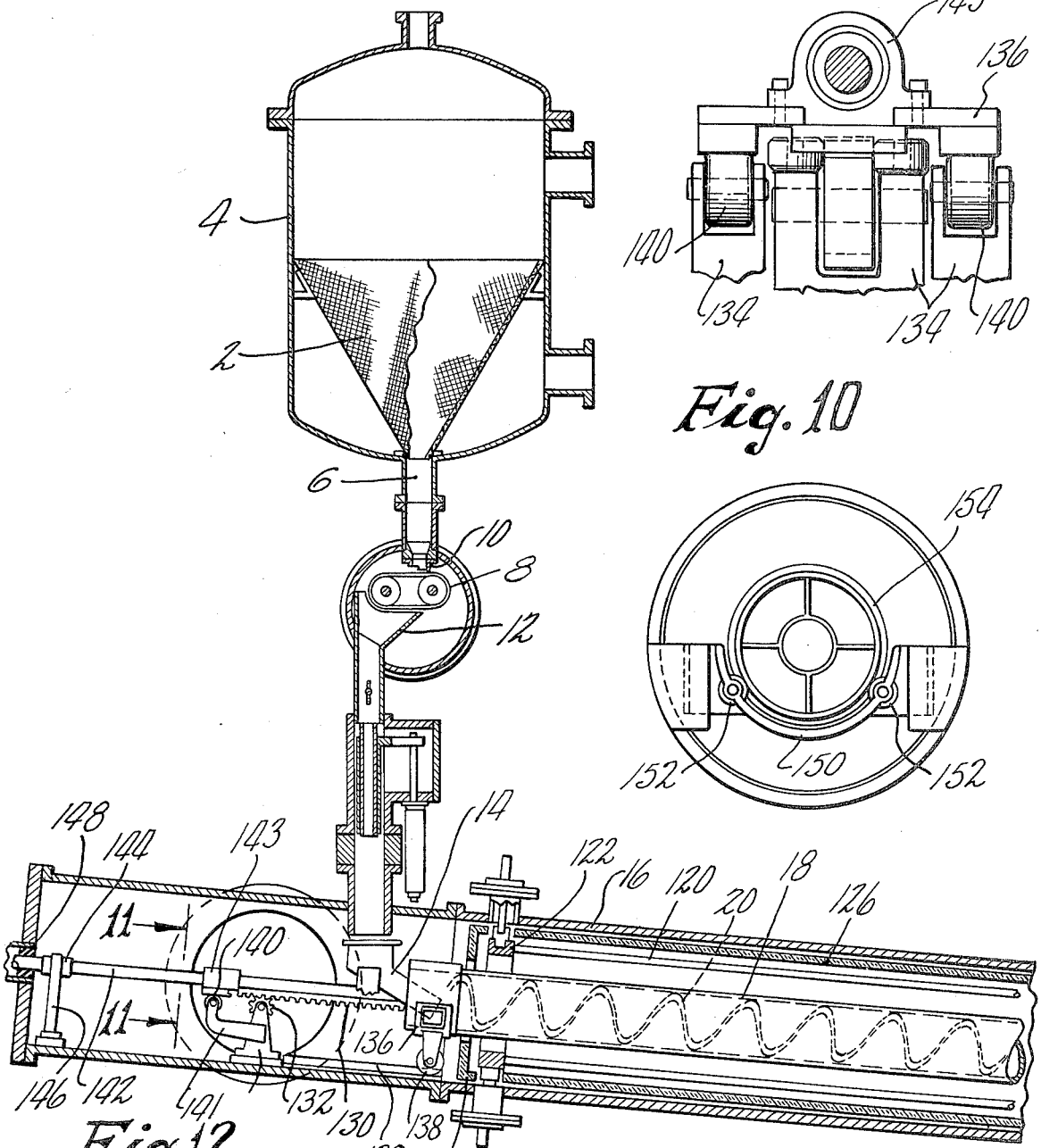
Fig. 11
Fig. 10
Fig. 12
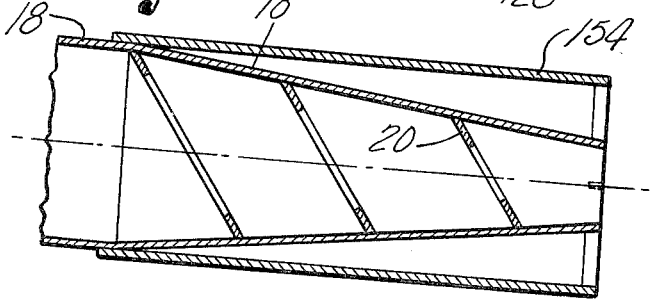

8
8
WATER IN
110
84
70
108
112
70
106
34
32

4

PRESS FOR PARTICULATE MATERIAL

SUMMARY OF THE INVENTION

This invention is in some respects an improvement on the apparatus of the Cox et al U.S. Pat. No. 3,832,107. The present application has an improved press construction that simplifies press operation and minimizes ancillary structures for effective press operation.

One of the features of the invention is the insertion and removal of the container for the billet at the same level as the container occupies during press operation to facilitate this operation. Another feature is the arrangement for supporting the heating structure for the press ram. Another feature is the withdrawal of the container heating structure to facilitate the removal of a completed billet in its container. Other features will be apparent as the description develops.

According to the present invention the container to receive the particulate material is supported on a base plate that is laterally movable on a carriage to withdraw the completed billet from the machine and to position an empty container in the press. To facilitate removal of the container, the heating mechanism that surrounds the container is elevated within the press structure to raise it above the container and out of the path of the withdrawal movement.

The foregoing and other objects, features, and advantages of the present invention will become more apparent in the light of the following detailed description of preferred embodiments thereof as illustrated in the accompanying drawing.

BRIEF DESCRIPTION OF THE DRAWING

FIG. 3 is a vertical sectional view through the particulate material feeding mechanism and furnace.

FIG. 10 is a sectional view along line 10—10 of FIG. 2.

FIG. 11 is a sectional view along line 11—11 of FIG. 2.

FIG. 12 is a sectional view through the end of the conveyor tube.

DESCRIPTION OF THE PREFERRED EMBODIMENT

Figure 1:
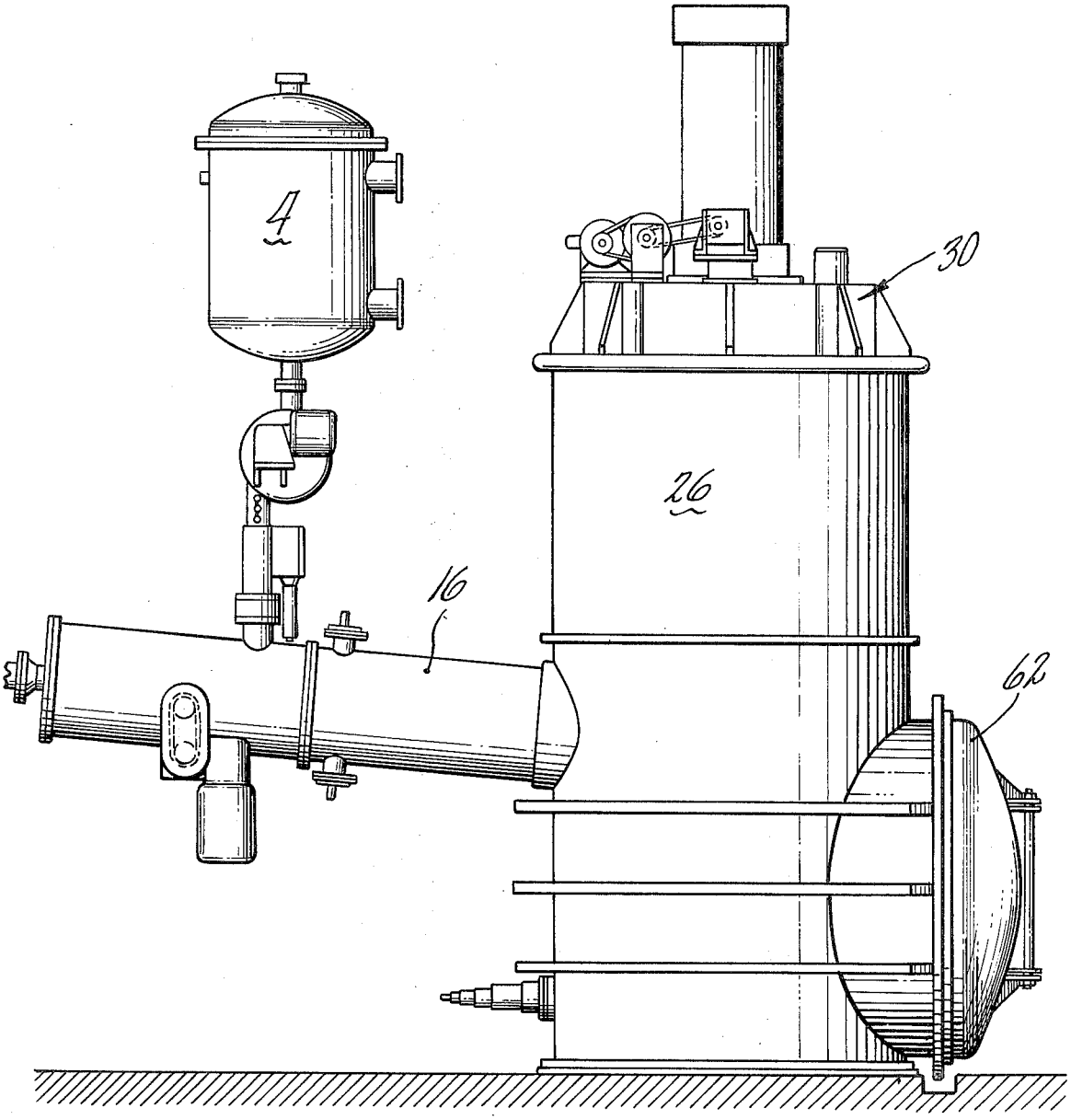
FIG. 1 is an elevation of the apparatus.

The apparatus includes a screen hopper 2, FIG. 3, enclosed within a vacuum chamber 4, FIG. 1. Particulate material, for example chips of an alloy, are placed within the hopper to be discharged through a duct 6 at the bottom of the chamber. The screen permits removal of small particulates of a size to pass through the screen. The material from the hopper drops onto a conveyor belt 8 through an orifice 10 which controls the flow onto the belt. As the belt moves below the orifice it picks up the particulate material and drops it at the end of the conveyor into a chute 12 communicating with a funnel 14 within a slanting furnace enclosure 16. This mechanism is claimed in the copending application of Jerry A. King, Ser. No. 637,625, filed Dec. 4, 1975, having the same assignee as this application.

Figure 2:
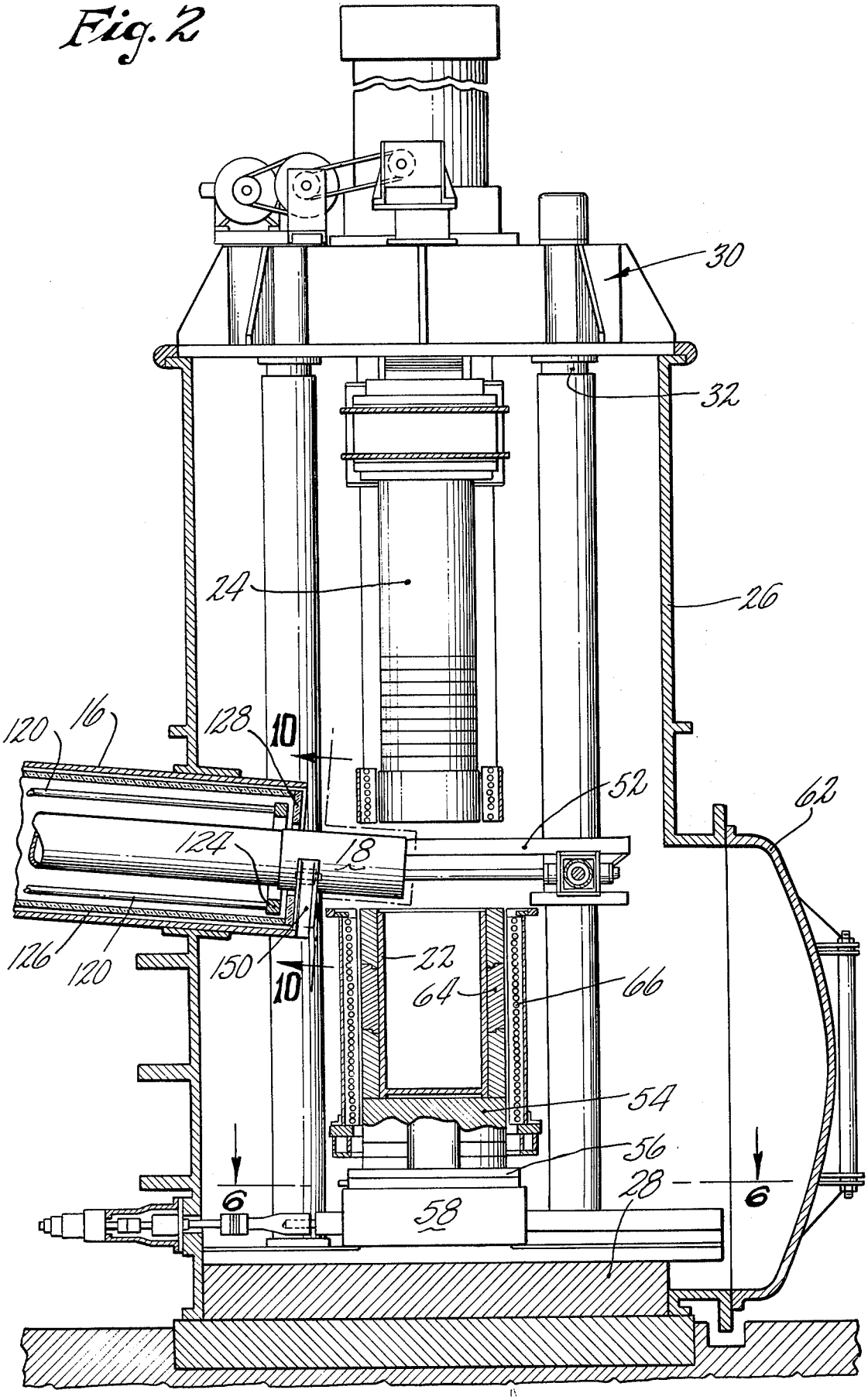
FIG. 2 is a vertical sectional view through the press.

From the funnel 14 the particulate material discharges into a rotary conveyor tube 18 which has a helical rib 20 on the inner surface to translate the material within the tube and discharge it at the delivery end of the tube. The delivery end of the tube is located above the container 22 in which the material is compacted by the press as shown in FIG. 2. In addition to rotation of the conveyor tube 18 it is also translated to the left, from the position shown to retract the delivery end of the tube so that the press ram 24 may move down and enter the container in compacting the particulate material. The funnel 14 moves with the tube 18 in its translatory movement within the furnace enclosure 16. This enclosure terminates within the press enclosure 26 so that the press, the conveyor tube and hopper may all be within a vacuum when in operation. The conveyor tube and its support structure are described in detail and claimed in the copending application of Donald G. MacNitt, Jr., Ser. No. 637,622, filed Dec. 4, 1975, having the same assignee as this application.

Figure 9:
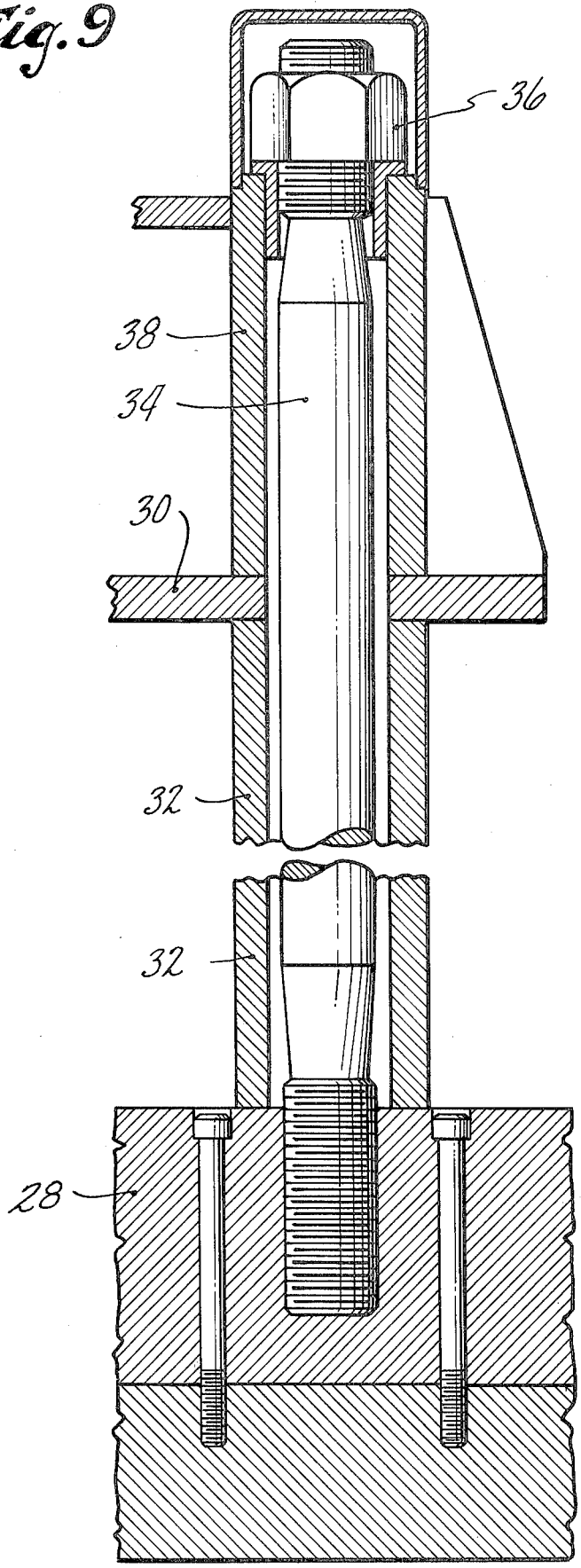
FIG. 9 is a vertical sectional view through one of the press tie bolts.

As shown in FIG. 2, the press has a base 28 and a head 30 held in spaced relation to one another by a plurality of columns 32 each surrounding a tie bolt 34, FIG. 9, that serves to hold the plates in position during operation. Each bolt is threaded securely into the base structure and passes through the head structure to receive a nut 36 at its upper end. This nut engages a tube 38 surrounding the upper portion of the bolt and forming part of the head structure. By tightening the nut, a load is applied to the tie bolts and thus to the columns to hold the top plate in proper relation to the head structure during press operation. The mechanism by which the desired preload is applied to the bolts is described in more detail and claimed in the application of Vernon F. Manz et al, Ser. No. 637,627, filed Dec. 4, 1975 and assigned to the same assignee as this application.

The head carries the press ram 24, FIG. 2, which is on the end of the piston rod 40 of a hydraulic actuator 42 securely attached to the head plate. A bellows 44 surrounding the top end of the ram structure prevents foreign matter from contacting the piston rod and permits maintenance of a vacuum in the enclosure 26. Below the bellows a water jacket 45 surrounds the ram structure and prevents transfer of heat to the hydraulic actuator. The bottom end or head 46 of the ram, the portion entering the container, is heated by a heating ring 48 that surrounds the head when the latter is retracted as shown. This ring 48 is on struts 50 on a carriage 52 that is vertically movable as will be described.

Figure 6:
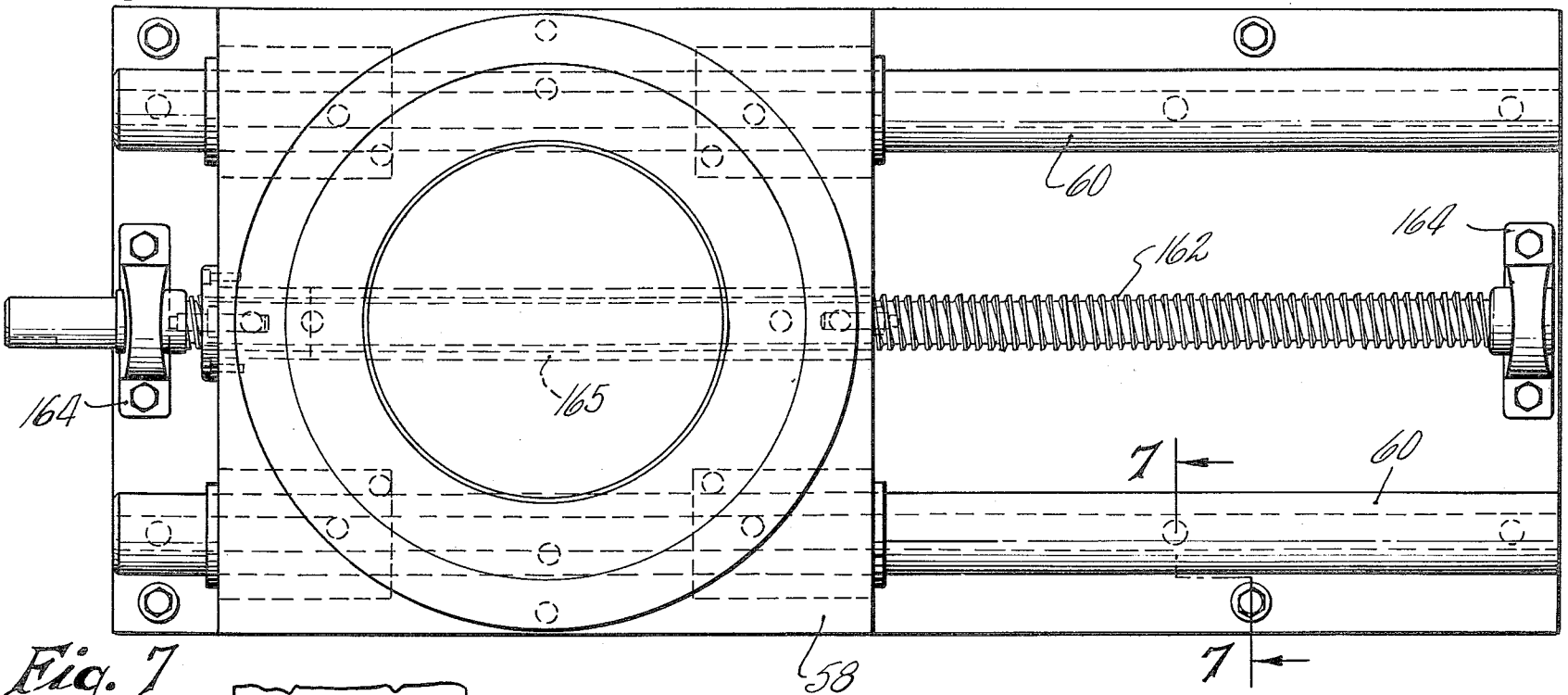
FIG. 6 is a horizontal sectional view along line 6—6 of FIG. 2.
Figure 7:
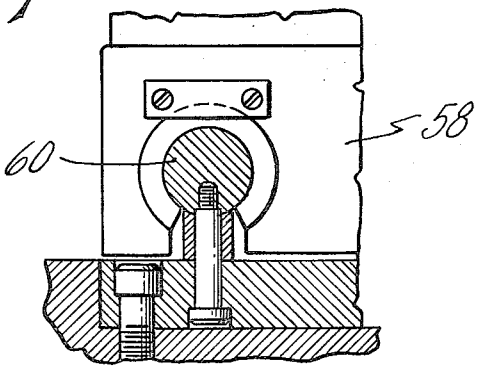
FIG. 7 is a sectional view of a detail along line 7—7 of FIG. 6.

The container for the particulate matter is supported on a base 54 which in turn is on a cooled plate 56 on a carriage 58. The carriage is guided on rods 60, FIG. 6, for lateral movement to translate the container into a position for removal from the press. A suitable vacuum tight door 62, FIG. 2, permits access to the container. The container is surrounded by and contacted and supported by stacked supporting rings 64, FIG. 2, which rest on the base 54 and move with the container. These support rings are spaced within and surrounded by a heating coil 66 shown as an induction coil. The rings 64 form a susceptor, which is heated by the induction coil and serves to maintain the container and the material therein at the proper temperature for compaction. This coil is mounted on the underside of carriage 52 to move therewith so that as the carriage is moved up at the completion of the press operation the heater moves with it so that lateral removal of the container is possible.

The carriage 52 is guided on a plurality of water cooled guide tubes 70 fixed in the base plate and slidably mounted in the head plate. The carriage is moved by threaded bolts 72 turnable in bearings 74 on the base plate and turnable in bearings 76 in the head structure. The carriage has tubes 78 to receive these threaded bolts and nuts 80 are fixed in these tubes. Suitable driving means are provided for these bolts. As they are driven, the carriage 52 is moved vertically into inoperative position. The heating ring 48 is also carried by this carriage.

Figure 5:
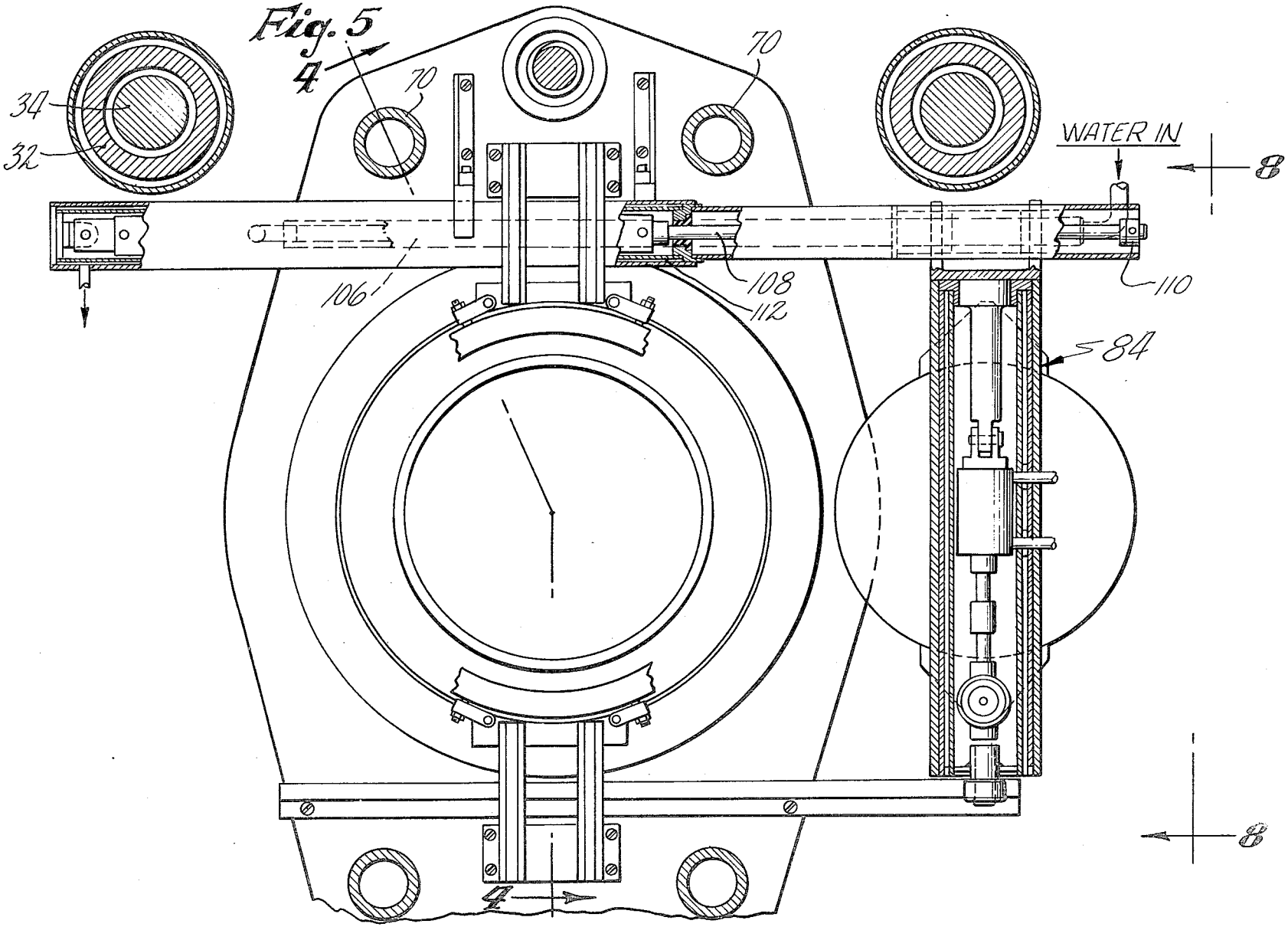
FIG. 5 is a horizontal sectional view along line 5—5 of FIG. 4.

A slide 84, FIG. 5, is also mounted on the carriage to move therewith. This slide moves laterally on a support rod 86, FIG. 8, and a rail 88 fixed on the carriage, a roller 89 on the carriage engaging the rail. On the slide are opposed cover clamping jaws 90 and 92, the jaw 90 being fixed and the jaw 92 being slidable toward and away from jaw 90 to engage between them the cover 94 for the container. Jaw 92 is on a bracket 96 that receives a pin 98 connected to the piston rod 100 of a hydraulic actuator 102. The latter is supported in the slide 84. It should be noted that a water jacket 104 surrounds the actuator to prevent overheating.

The slide is movable from the inoperative or loading position shown into a position with the cover directly over the container by a pneumatic actuator 106 overlying the support rod 86. The projecting piston rod 108 is connected by a link 110 to the slide. A water jacket around the actuator prevents overheating. The cover slide and associated mechanism are described in detail and claimed in the copending application of Donald G. MacNitt, Jr., Ser. No. 637,623, filed Dec. 4, 1975 and having the same assignee as this application.

In operation, after the enclosures have been evacuated, the conveyor belt is started to supply particulate material from the hopper to the scoop and thence to the conveyor tube. In the hopper the particulate material may be dried and degassed as described in the Cox et al U.S. Pat. No. 3,832,107. As the material passes along the conveyor tube it is heated and further degassed by heat from a plurality of parallel heating elements or rods 120 extending substantially the length of the conveyor tube and in surrounding relation. End rings 122 and 124 interconnect the ends of the several rods and hold them in position. A cylinder 126 of insulation surrounds these heating elements and end disks 128 close the ends of the cylinder, the conveyor tube projecting through these disks. This furnace arrangement is described in detail in the copending application of Vernon F. Manz et al, Ser. No. 637,626, filed Dec. 4, 1975, and having the same assignee as this application.

The heating effect of the heating rods may be such as to bring the particulate material in the conveyor tube nearly to melting temperature if desired or to such a temperature as to heat treat it or to make it superplastic in preparation for compaction. The rotation of the tube and the slant of the tube combined with the helical rib on the inside causes the particles to move at such a speed as to permit them to reach the desired temperature before being discharged into the container. When the latter is filled, the conveyor tube is retracted to withdraw the end from alignment with the ram head so that the press may operate.

Retraction of the conveyor rod is accomplished by a rack 130, FIG. 3, and a driving pinion 132. The pinion is on a bracket 134 on the wall of the enclosure and the rack is on a carriage 136 on which the outer end of the conveyor tube is mounted. This carriage has rollers 138 on a track 139 on the enclosure, and other rollers 140 on a part of the bracket 134, these rollers 140 engaging the carriage. The drive shaft 142 for the conveyor tube is also journaled in a bearing 143 in the carriage and in another bearing 144 in a bracket 146 on the enclosure 16. The shaft extends through a vacuum seal 148 in the enclosure. At the inner end the conveyor tube is supported on a yoke 150 carrying rollers 152 that engage a cylindrical end 154 on the tube such that the tube moves axially relative to the yoke. As above stated this conveyor tube and associated structure are described and claimed in the above cited copending application Ser. No. 637,626.

Figure 4:
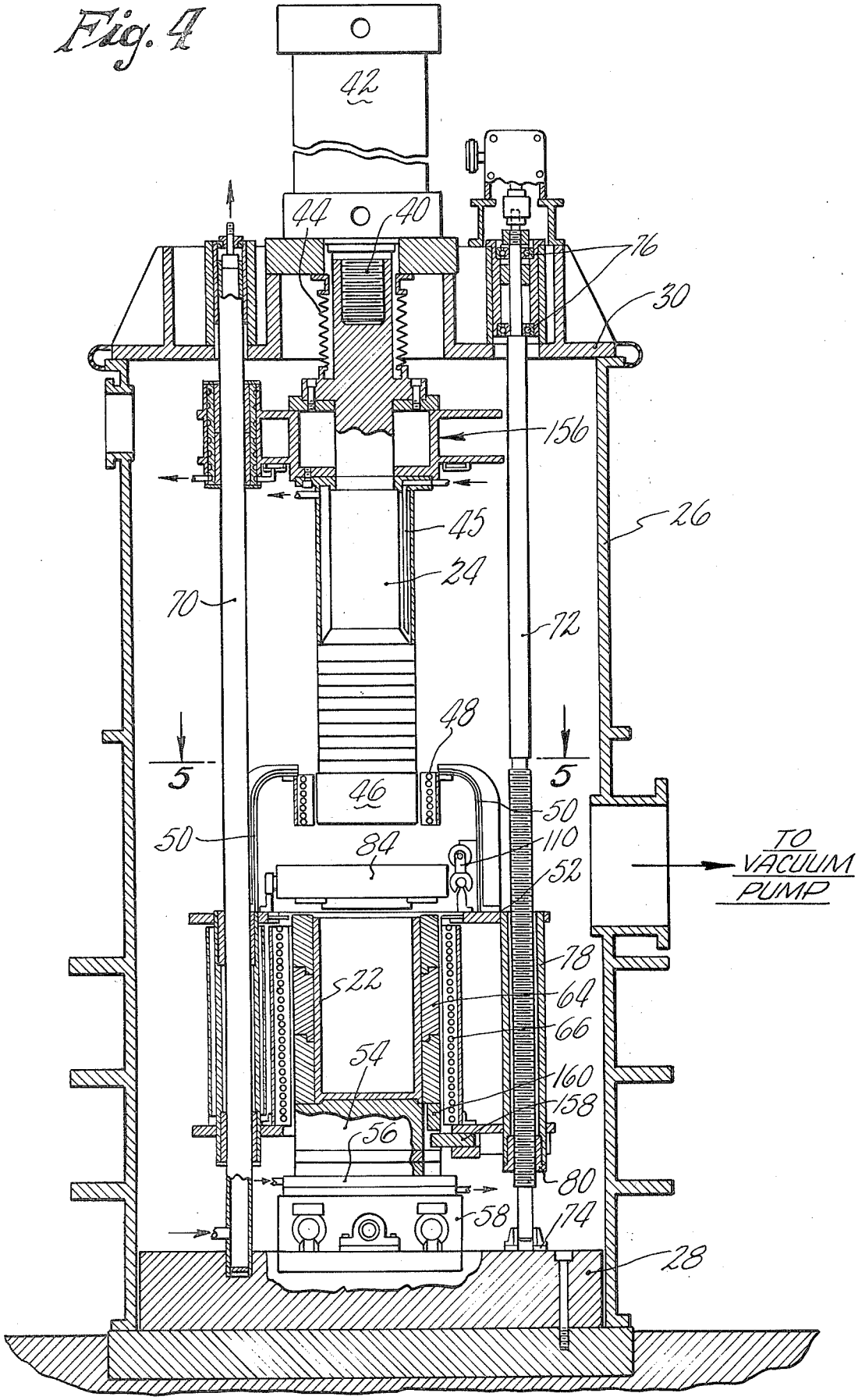
FIG. 4 is a vertical sectional view substantially at right angles to that of FIG. 2, more specifically along line 4—4 of FIG. 5.

When the tube is retracted, the ram moves down into the container and compresses the particulate material therein, such material being kept at the optimum temperature for effective compacting. The ram is guided, in part, by a guide structure 156 carried by the ram and fitting around the rods 70 as shown in FIG. 4 and guided by these rods. This guide structure is desirably fluid cooled as shown to minimize thermal expansion. The ram is then retracted, the conveyor tube advanced, and additional particulate material added to refill the container. When the container is again full, the tube is withdrawn, the ram again moved down to compact this added particulate material. A further filling and compaction may be necessary to fill the container adequately although two fillings are generally the rule.

Figure 8:
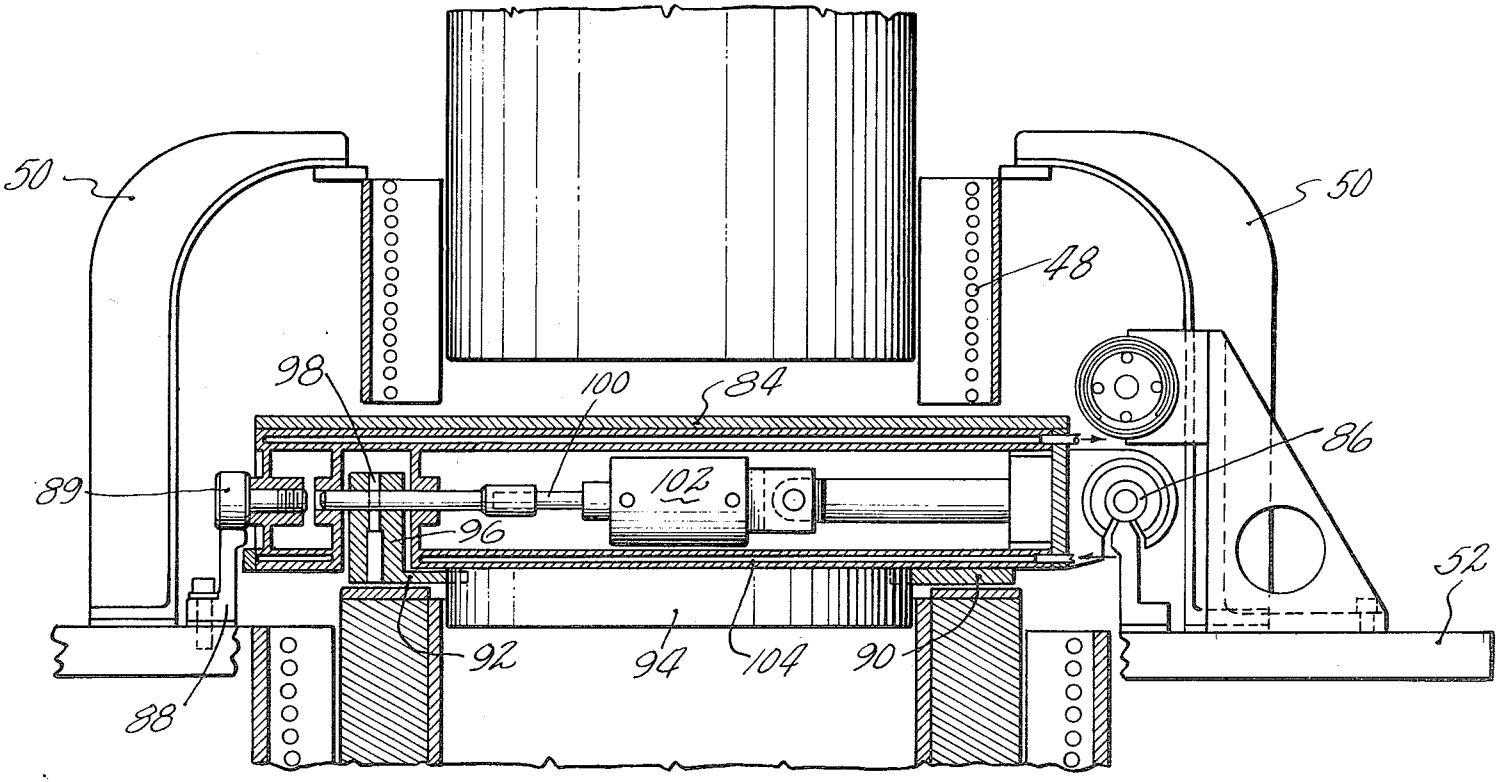
FIG. 8 is a fragmentary vertical view through the cover mechanism as seen along line 8—8 of FIG. 5.

The cover is then positioned on the container. To do this the cover, which is held in the clamps while the associated slide is in the position shown, is moved laterally into vertical alignment with the container by translating the slide as above described. With the cover in position above the container, the carriage 52 is moved down to place the cover within the end of the container as shown in FIG. 8. At this point the jaws are released and the cover is released, resting on the top of the particulate material. The slide is then moved to the inoperative position of FIG. 5, and the ram is moved down to force the cover into secure relation on the particulate material and, in most cases, to further compact the material. The cover is preferably of such a dimension that, being relatively cool it will fit within the container but such that when the container is cooled to the same temperature as the cover, a tight seal will be obtained. The container and cover may, for example, be made of stainless steel if the particulate material is one of the group of high temperature alloys commonly referred to as superalloys. As above stated, the cover clamp and associated mechanism are described and claimed in Ser. No. 637,623, above identified.

Removal of the container necessitates first a vertical movement of the carriage 52 to raise the heating coils 66 to a point above the container. The driving means for the rods is actuated to raise the carriage, carrying with it the heating ring 48 and the cover positioning mechanism and also the susceptor rings 64. To move the susceptor rings with the carriage 52 the latter has radially slidable latches 158 that are normally in the position shown in FIG. 4 so as to engage a ring 160 below the rings 64. These latches may be moved radially outward manually if it is desired to move the carriage 52 and coil 66 upward during the machine operation for any reason.

The upward movement of the carriage 52 does not normally occur until the container has cooled to a relatively low temperature after the completion of the filling operation. This cooling is enough to separate the container by thermal contraction from the rings 64 so that they may be moved up freely on the container, leaving the latter in position on the support plate.

When the carriage 52 is in inoperative position, the container slide in carriage 58 is translated by means of a feed screw 162 mounted in brackets 164 on the base plate and turnable in a threaded sleeve 165 in the carriage 58. Movement of the carriage positions the container close to the access door for convenient removal of the container after the vacuum in the enclosure is relieved so that the door can be opened.

Placement of a new, empty container in position on carriage 58 and a cover in position between the jaws makes the device ready for another operation.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A press for compacting particulate material including:

a base plate supporting a container;

a ram movable to compact material in the container, said ram having a head to enter into the container, said ram having an inoperative position with the head above and spaced from the container;

a heating ring adjacent said head when the head is in inoperative position;

a heating coil above the base plate and in a position to surround a container on the base plate, and a vertically movable carriage on which the heating coil and ring are mounted for vertical movement into inoperative position.

2. A press as in claim 1 in which a horizontal, movable slide mounted on the base plate supports the container for movement laterally from the operative position below the ram.

3. A press as in claim 1 in which the carriage has a horizontally movable slide thereon for movement into and out of alignment with the ram.

4. A press as in claim 3 including brackets on the carriage for supporting the heating ring above the horizontally movable slide thereon.

5. A press for compacting particulate matter including:

a base structure for supporting a container in which the material is compacted, a head structure spaced from the base structure, a plurality of tie bolts holding the structures in relation to each other, a ram carried by the head structure, a plurality of guide elements between the structure and parallel to the tie bolts, a vertically movable carriage guided by said elements, a heating coil mounted on the carriage and positioned above the base structure and in a position to surround a container thereon, and means for moving the carriage vertically to position the heating coil above the position of the container on the base structure.

6. A press as in claim 5 including a horizontally movable slide on the base structure for which the container is positioned for lateral movement of the container.

7. A press as in claim 5 including a threaded rod between the structures and engaging the carriage for vertical movement of the carriage.

8. A press as in claim 5 including a conveyor tube for delivering particulate material to the container and means for moving the tube axially to withdraw it from interference with the vertical movement of the ram and the heating coil.

9. A compacting apparatus for particulate material including:

a furnace having heating means therein, a conveyor tube extending through said furnace for delivering particulate material therethrough to the discharge end, a press at the discharge end of the tube having a ram and a base plate toward which the ram is movable for compacting material, the base plate adapted to support a container for receiving the material from the tube, the ram having a head positioned to enter the container, a heating coil above said base plate for heating the container, means for moving said coil vertically to position it in inoperative position above the container, and means for retracting the tube to permit the vertical movement of the coil.

10. Apparatus as in claim 9 including a horizontal slide on the base plate for supporting the container and for moving the container out from alignment with the ram.

11. Apparatus as in claim 9 including a vertically movable carriage on which the coil is mounted for positioning the coil in inoperative position.

12. Apparatus as in claim 9 including a heating ring for heating the head on the ram, and means for supporting the ring on said carriage.

* * * * *